US005930985A

United States Patent [19]

Jacobs

[11] Patent Number: 5,930,985

[45] Date of Patent: Aug. 3, 1999

[54] INDIAN BRIDLE

[76] Inventor: Diana L. Jacobs, 9404 Philadelphia Rd., Baltimore, Md. 21237

[21] Appl. No.: 08/938,818

[22] Filed: Sep. 26, 1997

[51] Int. Cl.[6] ..... B68B 1/04

[52] U.S. Cl. ..... 54/6.1

[58] Field of Search ..... 54/6.1, 36; 119/805; 24/17 B, 18, 127, 197, 714.7

[56] References Cited

U.S. PATENT DOCUMENTS 1,094,462 4/1914 Mork .
1,552,145 9/1925 Haile .
2,563,533 8/1951 Knox ..... 119/805
2,625,780 1/1953 Flatt ..... 54/6.1
3,988,033 10/1976 Watkins et al. ..... 54/15 X
5,715,578 2/1998 Knudson ..... 24/17 B X

*Primary Examiner*—Robert P. Swiatek
*Attorney, Agent, or Firm*—Patent & Trademark Services; Joseph H. McGlynn

[57] ABSTRACT

A bridle which has a first portion that is placed inside the horse's mouth and which can serve as reins so the rider can control the horse. It has a second portion which secures to the first portion and which is readily adjustable so the bridle can be attached to different size animals.

2 Claims, 1 Drawing Sheet

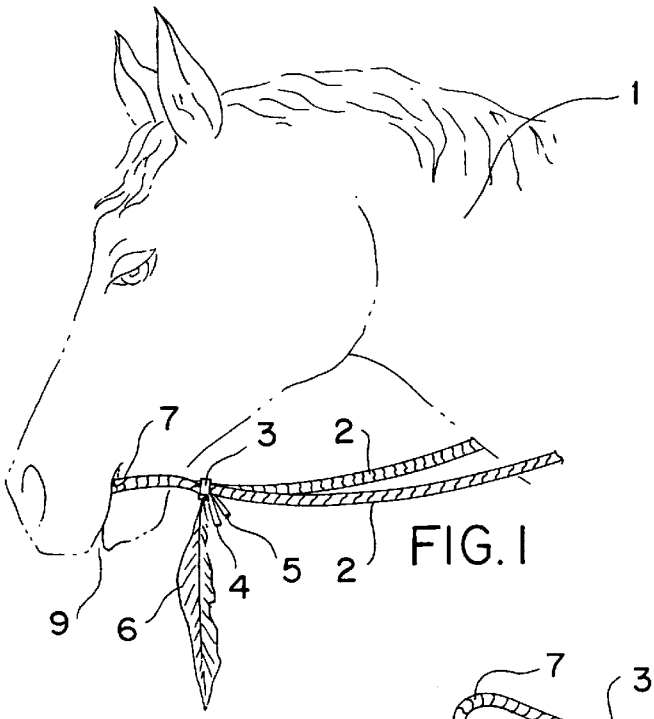
FIG. 1
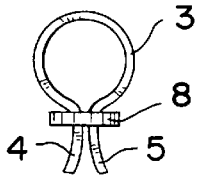
FIG. 3
FIG. 2
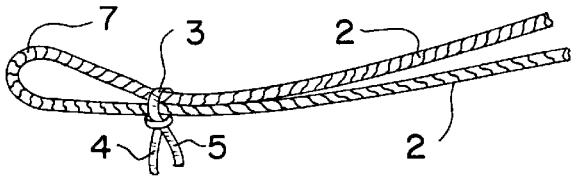
FIG. 4
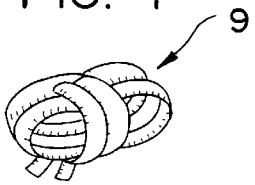
FIG. 5
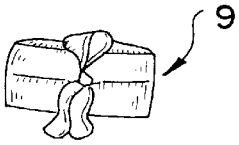
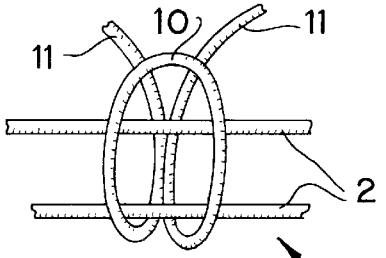
FIG. 7
FIG. 6
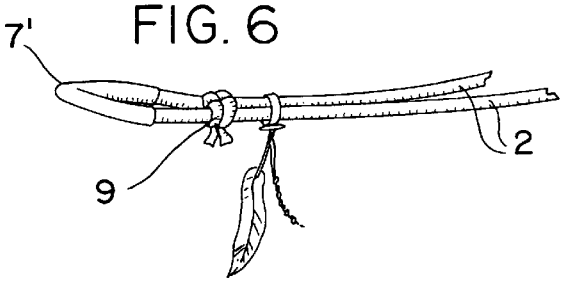
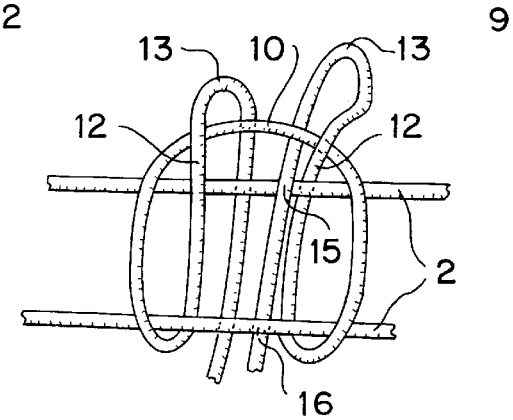
FIG. 8

INDIAN BRIDLE

BACKGROUND OF THE INVENTION

This invention relates, in general, to bridles, and, in particular, to adjustable bridles for horses.

DESCRIPTION OF THE PRIOR ART

In the prior art various types of bridles have been proposed. For example, U.S. Pat. No. 1,094,462 discloses a bridle which has a first portion which fits into the horse's mouth and which has a pair of rings secured to each end. A second portion has snap hooks which attach to the rings and which passes under the horse's lower jaw.

U.S. Pat. No. 1,552,145 discloses a bridle which has an enlarged portion which fits under the horse's lower jaw and a second portion attached thereto which fits over the horse's upper jaw.

U.S. Pat. No. 3,998,033 discloses a bridle having a plurality of straps which fit over the horse's head and neck and a second plurality of straps that fit over the horse's upper and lower jaws.

While the prior art devices work for their intended purposes, they suffer from many drawbacks. For example, the U.S. Pat. No. 1,094,462 device has rings which can be painful to the sides of the animal's mouth. In addition, the device uses a buckle to adjust the bridle to different sizes which can be difficult and time consuming to adjust.

The U.S. Pat. No. 1,552,145 device utilizes a similar adjustment buckle which suffers the same disadvantages as the U.S. Pat. No. 1,094,462 device and the enlarged portion under the animal's lower jaw can cause injury.

The U.S. Pat. No. 3,998,033 device is not readily adjustable around the horse's upper and lower jaws and, in addition, has numerous straps that must be individually adjusted for different sizes of horses.

What is need is a simple and effective bridle that is easily and conveniently adjusted so it can be used with horses of different sizes and will not harm the animal in any way. In addition, the bridle should give the rider or trainer of the horse the ability to easily control the horse.

SUMMARY OF THE INVENTION

The present invention comprises a bridle which has a first portion that is placed inside the horse's mouth and which can serve as reins so the rider can control the horse. It has a second portion which secures to the first portion and which is readily adjustable so the bridle can be attached to different size animals.

It is an object of the present invention to provide a new and improved bridle which will be easily attached to a horse.

It is an object of the present invention to provide a new and improved bridle which is adjustable for different size animals.

It is an object of the present invention to provide a new and improved bridle which will not harm the horse.

These and other objects and advantages of the present invention will be fully apparent from the following description, when taken in connection with the annexed drawings.

BRIEF DESCRIPTION OF THE DRAWINGS

FIG. 1 is a side view of the present invention positioned on a horse.

FIG. 2 is a side view of the present invention removed from the horse.

FIG. 3 is a top view of the holder for the present invention.

FIG. 4 is a top view of a modified holder for the present invention.

FIG. 5 is a bottom view of the modified holder of FIG. 4 for the present invention.

FIG. 6 is a side view of another embodiment of the present invention removed from the horse.

FIG. 7. shows an intermediate step in making the holder of FIG. 4.

FIG. 8. shows the next intermediate step in making the holder of FIG. 4.

DESCRIPTION OF THE PREFERRED EMBODIMENT

Referring now to the drawings in greater detail, FIG. 1 shows the present invention as it is attached to a horse 1. The bridle ends 2 will be used as reins to control the horse when it is being ridden. The bridle ends can be attached together and looped over the horse's head, or can be two separate ends which are passed around the horse's neck. The bridle has a loop 7 at one end (see FIG. 2) and this loop will be placed inside the horse's mouth 9, as shown in FIG. 1. The loop 7 will encircle the lower jaw of the horse when it is in final position and will be held in place by a holder 3, 8 as will be more fully explained below. In addition, decorations such as the feather 6 can be attached to the holder by any conventional means.

It should be noted that the bridle is shown in FIGS. 1 and 2 as a rope, however, this is merely for illustrational purposes. The bridle can be made from any material which will be strong enough to serve the intended purpose such as, but not limited to, leather straps. In addition, the holder 3 shown in FIG. 3 can also be made from different materials such as, but not limited to, rope, leather and plastic.

Once the loop 7 is placed inside the horse's mouth and around its lower jaw, it must be securely fastened in that position. In order to accomplish this a second loop of material 3, having ends 4, 5, is passed around the two portions of the bridle, as shown in FIG. 2 in order to maintain the loop 7. The loop 3 is maintained by a ring 8 of material such as, but not limited to rope, leather, metal and plastic. The ring 8 has a center aperture through which the ends 4, 5 can be passed, and the diameter of the aperture should be small enough that the ends 4, 5 will be held in place by friction between the inside diameter of the aperture and the outside dimensions of the two ends 4, 5.

In order to use the present invention, a loop 7 is formed in the bridle, and the loop 3 is positioned to hold the loop 7. Next the ring 8 is placed over the ends 4, 5 to hold the loop 3 snugly in place around the bridle ends 2. It should be noted that the size of the loop 7 is not material at this time as long as it is larger than the circumference of the lower jaw of the horse. In fact, due to the ease with which the loop can be adjusted later, the loop 7 can be many times larger than necessary at this point.

However, it will be necessary that the loop 3 will be just large enough so it will tightly encircle the two ends 2 of the bridle. That is, the loop 3 should be tight enough to hold the loop 7, but still able to slide along the ends 2 of the bridle in order to change the size of the loop 7.

Next, the loop 7 will be placed inside the horse's mouth with the holder 3, 8 positioned below the lower jaw. Next, the loop 7 can be adjusted to fit the particular horse it is used on, by merely sliding the loop 3 and the ring 8 along the ends 2 until the loop 7 is the proper size to fit snugly around the horse's lower jaw. As can be seen, the loop 7 can be quickly and easily adjusted to fit any horse no matter how big or how small the horse is. In addition, the material of the bridle can be selected so that it will not harm the horse.

The embodiment of the invention shown in FIG. 6 is a modified version of the invention of FIG. 2. In the FIG. 6 embodiment the loop 7 has a coating of latex or some other soft material 7' which will protect the inside of the horse's mouth when the bridle is being used. In addition the holder 9 shown in FIGS. 4 and 5 is used.

The modified holder 9 has the same function as the holder 3 shown in FIGS. 1–3, and works in substantially the same manner. In order to make the holder 9, a piece of rope or similar material is formed into a loop 10 as shown in FIG. 7, and placed on top of the two ends 2 of the bridle, while the two ends 11 are placed under the ends 2 of the bridle. Next the ends 11 are brought inside the loop 10, as shown at 12, passed over the loop 10 as shown at 13, and then passed under the loop 10. The ends 11 are then passed over the top end 2 as shown at 15 and then passed under the bottom end 2 as shown at 16. Next the ends 11 are pulled tight and the resulting holder 9 is shown in FIGS. 4 and 5.

Although the Indian Bridle and the method of using the same according to the present invention have been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A bridle adapted to be attached to a horse, said bridle comprising:

a first length of material, said first length of material having a loop formed therein and two ends, means for holding said loop in a selected position, said means comprising a second length of material having a loop and two ends, said loop in said second length of material being placed over said two ends in said first length of material, and said ends of said second length of material being placed under said two ends in said first length of material, said two ends of said second length of material being first passed over said loop in said second length of material and then under said loop in said second length of material, said two ends of said second length of material then being passed over a first of said two ends of said first piece of material and then passed under a second of said two ends of said first piece of material, said two ends of said second length of material then being pulled tight to form said means for holding said loop in a selected position.

2. A method of using a bridle, wherein said bridle comprising:

a first length of material, said first length of material having a loop formed therein, means for holding said loop in a selected position, said means comprising a second length of material with a loop formed in said second length of material, and said second length of material having two ends, a ring passing over said two ends of said second length of material, and said loop of said second length of material encircling said first length of material and maintaining said loop in said first length of material in said selected position, wherein said method comprises:

forming a loop in said first length of material, forming a loop in said second length of material, passing said loop in said second length of material around said first length of material in order to hold said loop in said first length of material in said selected position, passing a ring over said two ends of said second length of material, placing said loop in said first length of material in a horse's mouth so that said loop in said first length of material is inside the horse's mouth and said loop in said second length of material is beneath the horse's lower jaw, sliding said loop in said second length of material along said first length of material until said loop in said first length of material is snugly secured around the horse's lower jaw.

* * * * *